United States Patent [19]

Kees

[11] Patent Number: 4,784,106

[45] Date of Patent: Nov. 15, 1988

[54] SLING SHOT GUN DEVICE

[76] Inventor: Galen D. Kees, Rte. 2, Box 17B, Durand, Wis. 54736

[21] Appl. No.: 100,886

[22] Filed: Sep. 25, 1987

[51] Int. Cl.[4] ..... F41B 3/00

[52] U.S. Cl. ..... 124/20 R; 124/35 R; 124/87; 124/16

[58] Field of Search ..... 124/20 R, 17, 22, 35 R, 124/25, 37, 41 R, 41 A, 87

[56] References Cited

U.S. PATENT DOCUMENTS

| | | | |
|---|---|---|---|
| 1,832,340 | 11/1931 | Williams | 124/17 |
| 2,040,150 | 5/1936 | Merrill | 124/17 X |
| 2,501,568 | 3/1950 | Jarnagin | 124/20 X |
| 2,638,885 | 5/1953 | Keadle | 124/20 |
| 2,708,924 | 9/1951 | Hurlburt | 124/17 |
| 3,857,379 | 12/1974 | Burghardt | 124/20 R |
| 4,206,740 | 6/1980 | Lydon | 124/35 R X |
| 4,593,673 | 6/1986 | Kees | 124/20 |

*Primary Examiner*—Randolph A. Reese
*Assistant Examiner*—Anthony Knight
*Attorney, Agent, or Firm*—Leo Gregory

[57] ABSTRACT

A hand operated sling shot gun device consisting of a pistol grip having an extensible barrel, an elastic band carried by the barrel, a band holding member carried by the grip holding the band under tension with the device being loaded with a missile, the barrel and grip having sights and a band releasing member.

5 Claims, 3 Drawing Sheets

17
17a
17b
16
16a
16b
16c
13
13e
10
12
14
14a
14b
18
18d
21
21d
37
41
42
43
44
45
48
50
51
57
58
58a
59
59a
30
31
31a
31b
32
32a
32b
33
34
35
9

SLING SHOT GUN DEVICE

BACKGROUND OF THE INVENTION

1. Field of Invention

This invention relates to a sling shot or catapult type of a hand operated device.

2. Description of the Prior Art

There is a long history of the use of sling shot or catapult type of a device or weapon ranging from homemade Y-type of sling shots to more sophisticated types embodying metal fork frames and barrel and stock structures simulating both pistol and rifle types of gun structures.

The more sophisticated types of structures provide for cocking a missile loaded band for a delayed release in which the bands as known are held under tension both manually and also mechanically by a trigger type of release member.

The structure herein represents improvement in the prior art structure of applicant as disclosed in his U.S. Letters Pat. No. 4,593,673 issued June 10, 1986. The principal improvement is present in the trigger release member whereby the missile pouch is uniformly released from a cocked position and further improvement is present in the mechanism to hold the barrels in extended position.

SUMMARY OF THE INVENTION

The device herein comprises a sling shot or catapult type of structure which simulates a rifle structure having a telescopic barrel arrangement and provides for the use of a pellet type of missile.

It is an object of the invention herein to provide a sling shot type of device wherein the catapult band is not directly placed under tension by hand.

It is a further object herein to provide a device having an extensible barrel to place the catapult band under tension and a member to hold the band in tensed operating position loaded with a missile with the barrel locked into an extended position ready for firing the missile.

More specifically, it is an object of this invention to provide a rifle simulating sling shot type of device having an extensible barrel with a releasable locking lever, means holding the catapult band of the device under tension while loaded with a missile, said means being particularly adapted to release the catapult uniformly and sights to set an accurate flight course for the missile.

These and other objects and advantages of the invention will be set forth in the following description made in connection with the accompanying drawings in which like reference characters refer to similar parts throughout the several views.

DESCRIPTION OF A PREFERRED EMBODIMENT

Figures 1, 2, 3:
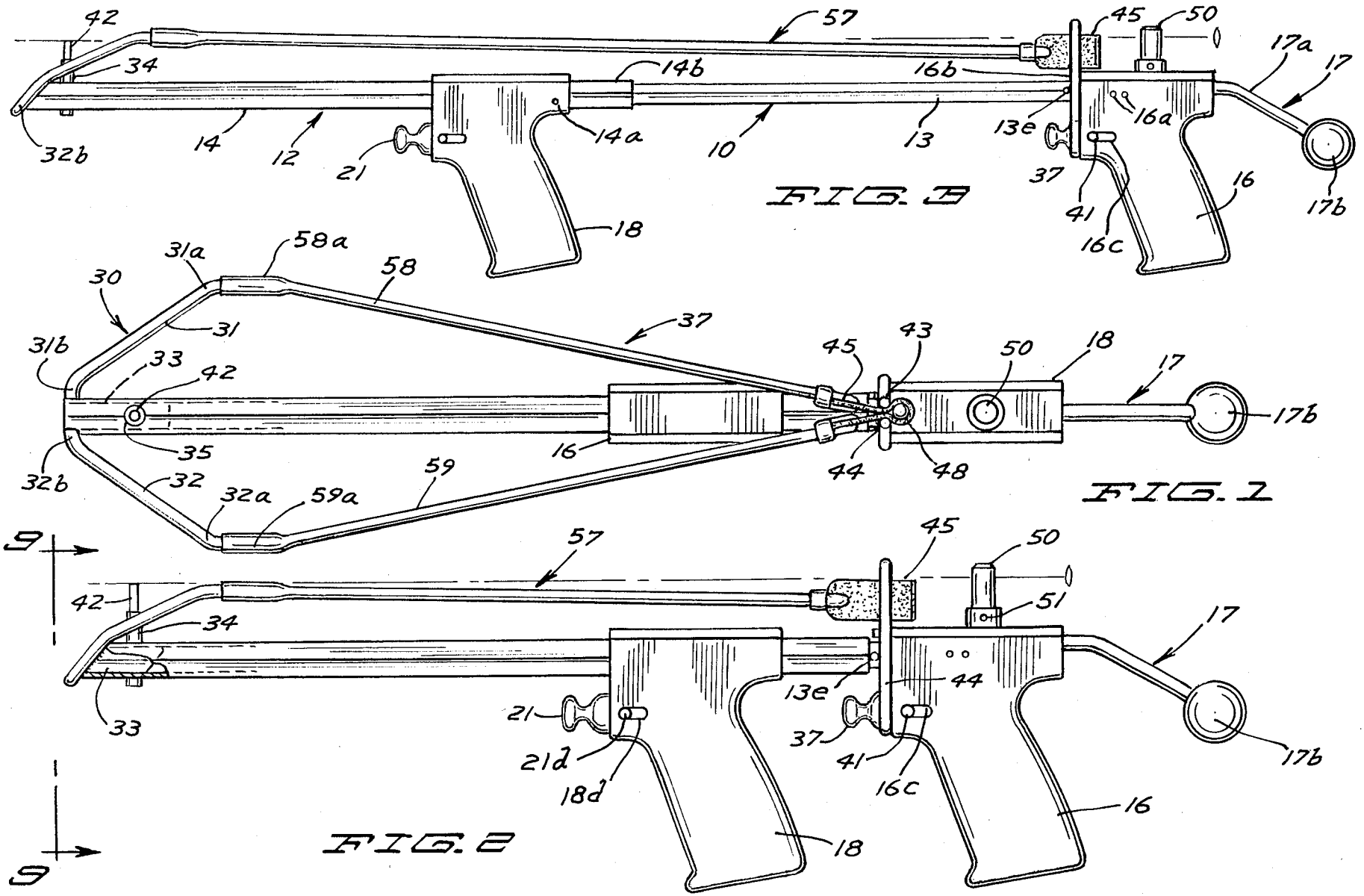
FIG. 1 is a top plan view of the structure herein.
FIG. 2 is a side elevational view of the structure of FIG. 1.
FIG. 3 is a view similar to that of FIG. 2 showing the structure thereof in extended form.

Referring to the drawings, a preferred embodiment of a sling shot or hand operated catapult device 10 is shown.

Comprising said device is a composite barrel 12 consisting of inner and outer telescopic or extensible barrel portions or barrels 13 and 14. Said outer barrel 14 is conveniently formed of standard square stock tubing and the inner barrel portion 13 may be made of square bar stock of such a transverse dimension as to have an interfitting sliding engagement with the barrel portion 14.

Mounted onto the rear end of the barrel 13 is a handle or grip 16 on the order of a pistol grip. Said handle is preferably a molded piece having a recess therein, not shown, to receive the adjacent end portion of said barrel 13 which is shown secured within said handle by transverse pins 16*a*.

Extending rearwardly of said handle 16 and preferably molded therewith is a cheek rest 17 comprising a downwardly rearwardly angled rod 17*a* having a ball 17*b* at the outer end thereof.

Figure 8:
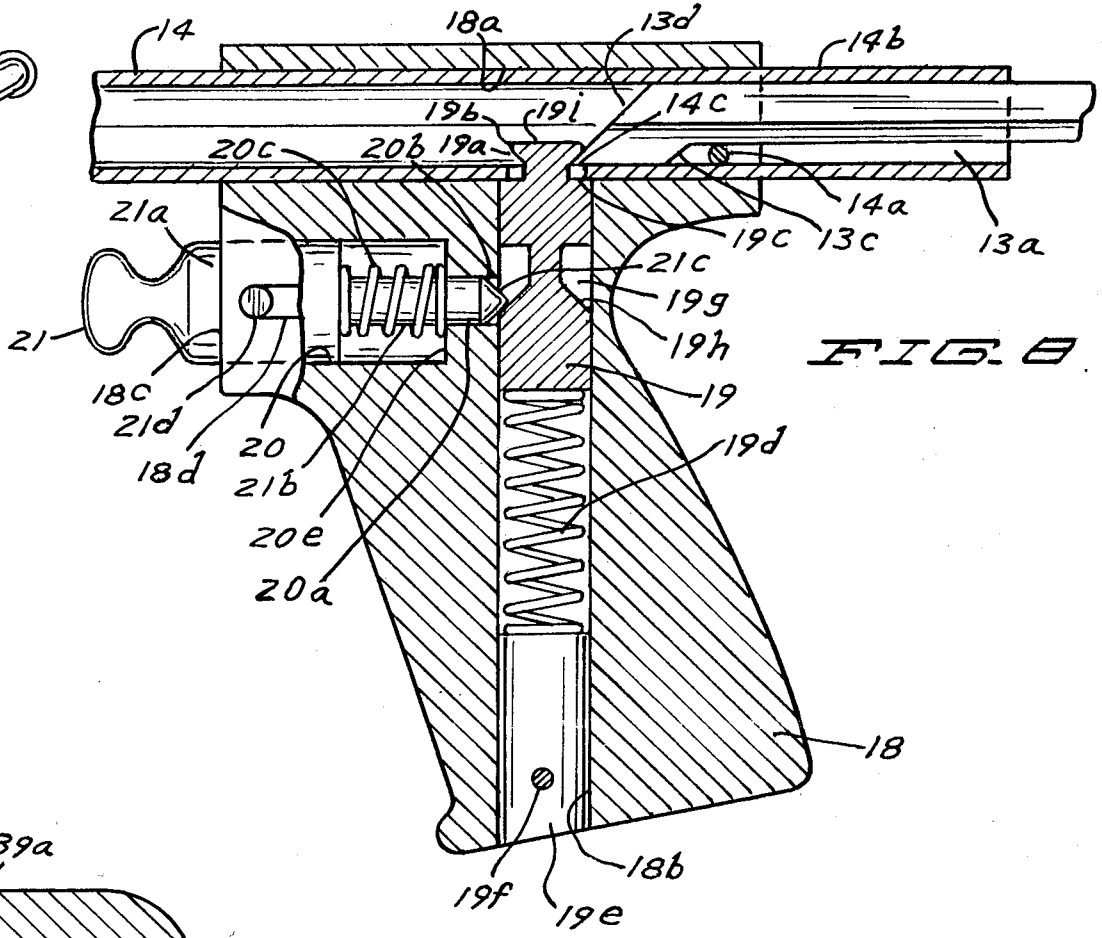
FIG. 8 is a broken view in side elevation on an enlarged scale showing a detail of structure.
Figure 9:
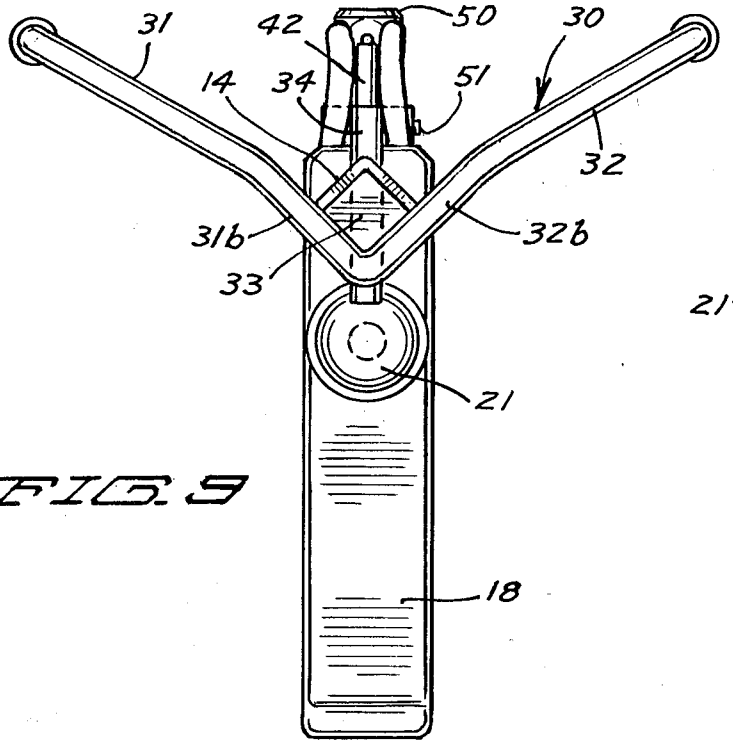
FIG. 9 is a view in end elevation on an enlarged scale taken on line 9—9 of FIG. 2 as indicated.

Referring now to FIG. 8, the barrel 13 is shown having a transverse open bottom slot 13*a* across the bottom thereof for a distance to accommodate the extension of the barrel 14. A ramp or end stop 13*c* is formed at the forward end of said slot 13 and cooperating therewith is a transverse pin 14*a* extending through the barrel 14 at the end limit point for the extension of said barrel 14. The adjacent end of said barrel 13 is inclined at 13*d*.

Mounted adjacent the rear end portion of the barrel 14 is a pistol grip type of handle 18 formed to have an exterior like that of said handle 16. Said handle 18 has a recess 18*a* extending longitudinally through an upper portion thereof as shown in FIG. 8.

Said stop pin 14*a* extends through the adjacent portion of said handle securing the same to said barrel 14. An end portion 14*b* of said barrel 14 extends rearwardly of said handle.

With continued reference to FIG. 8, a bore 18*b* extends upwardly through said handle 18 and disposed into the upper portion of said bore is a plunger 19 having an annular groove 19*a* about its upper end portion, its upper end 19*l* having a reduced width, said groove defining an upwardly inclined side wall 19*b* to receive thereagainst the slanted end wall 13*d* of the barrel 13 and a bottom wall 19*c*.

Urging said plunger upwardly is an underlying coil spring 19*d* held within said bore under compression by a plug 19*e* secured by a transverse pin 19*f*.

Spaced below said groove 19*a* about said plunger 19 is an annular groove 19*g* having an inclined bottom wall 19*h*.

Said barrel 14 has a bottom wall opening 14*c* to permit an upward projection therethrough of said upper portion 19*l* whereby the bottom wall 19*c* engages the underlying surface about said opening 14*c*.

A second bore 20 is disposed horizontally into said handle 18 from the forward portion 18*c* thereof at right angles to said bore 18*b* stopping short of said bore but extending forwardly thereof is a counter bore 20*a* of a reduced diameter communicating with said bore 18*b* through opening 20*b*.

A plunger 21 has its barrel 21*a* disposed in said bore 20 and a forward extension 21*b* thereof extends through said counter bore 20*a* and the opening 20*b* to engage the groove wall 19*h*. A coil spring 20*c* is disposed about said plunger portion 21*b* within said counter bore being secured at its rearward end to said plunger in a convenient manner and having the front wall 20*e* of the counter bore as a back rest and is under such compression as to retain the plunger 21 in a retracted position barely having engagement with the adjacent portion of the plunger 19. The tip 21*c* is shown to be conical and upon being extended, engages the inclined wall 19*h* to cause retraction of the plunger 19 from its projection through the opening 14*c*. Extending outwardly of said plunger 21 through a horizontal slot 18*d* in said handle 18 is a stop pin 21*d* which in being restrained by said slot, limits the outward movement of said plunger.

In operation, when the barrels 13 and 14 are retracted, the plunger 19 will be bearing against the bottom wall of the barrel 14, as the barrel is extended, its extension will be limited by the pin 14*a* and at this time the opening 14*c* will be centered over said plunger 19 which in being normally urged upwardly will project through the opening 14*c*. The barrel 14 will then be retracted slightly, as will be described, to have the inclined end 13*d* of the barrel 13 engage said groove 19*a* as a stop member.

Secured to the forward end of the barrel 14 is a fork member 30 consisting of two diverging arms 31 and 32 having terminal portions 31*a* and 32*a* extending rearwardly substantially parallel to said barrel 14. The forward end portions 31*b* and 32*b* of said arms are angled downwardly and secured as by welding to a stub member 33 of a size to be received into the end portion of said barrel 14 in a close fit and is secured therein by a vertical tubular pin 34 which extends through an accommodating hole 35 through said barrel and the insert 33 therein. Said arms diverge at approximately a 45° angle.

A suitable elastic band member 57 is secured at one end thereof to said end portions 31*a* and 32*a* of said arms. Said member 57 which is the catapulting agent may be variously formed but in the present embodiment it is shown and described as a pair of elastic tubular members 58 and 59, each secured at the outer ends 58*a* and 59*a* thereof to the respective adjacent ends of said arms 31 and 32 such as being pulled thereonto under tension for a frictional hold and at their other ends they are suitably connected by a flexible missile holding pouch 45. Said tubes 58 and 59 may be formed of surgical rubber tubing material.

Disposed through said tubular pin 34 and extending upwardly thereof is a flexible latex rubber cylindrical member 42 referred to herein as a sighting member and forms the front sight. Said sighting member is readily adjustable vertically and it may have vertically spaced annular stripes thereabout to judge elevation. Said sighting member is of such flexibility that contact with it by a projected missile will not deflect the missile.

Projecting forwardly of the upper edge central portion of the handle 16 is a molded extension or projection 16*b*.

Extending inwardly of said handle 16 is a recess 35 (FIG. 7) not unlike the recess 20 and disposed therein is a trigger mechanism 36 comprising a cylindrical plunger 37 having an annular groove 38 adjacent the forward end portion thereof, said groove having inclined walls 38*a* and 38*b* as shown. Said plunger has an axial bore 39 therein and extending transversely through said plunger to intersect the forward end of said bore 39 is a bore 40.

Disposed transversely through said bore 40 to extend outwardly of said handle 16 through openings 16*b* and 16*c* is a cylindrical safety bolt 41 having adjacent annular grooves 41*a* and 41*b*.

Said bore 39 has an aligned extension thereof at 39*a* extending into the underlying wall 35*a* of the recess 35. Positioned in said bore 39 is a coil spring 42 seated into said recess 39*a* and having its other end bear against a ball 43 which engages said annular grooves in said safety bolt 41 as will be described.

Said groove 41*b* of said bolt 41 is positioned such that when engaged by said ball 43, the adjacent end 41*c* of said bolt will be within the plunger 37 and the other end 41*d* of said bolt will be extending outwardly of said opening 16*c* which is formed in said handle as a slot for the rearward movement of said bolt. This is a triggering position. When said bolt 41 is positioned to have said ball 43 engage said groove 41*a*, the bolt then has its end 41*c* thereof extend outwardly of said opening 16*b* formed as a hole prohibiting an inward movement of said plunger placing the plunger in a locked or safety position.

Vertically disposed at the face or front end of said handle or grip 16 at either side of said plunger 37 are pouch pins 43 and 44 which extend downwardly to engage each side of the plunger 37 and extend upwardly sufficiently to engage and retain the missile pouch 45 therebetween.

Figures 4, 5, 6:
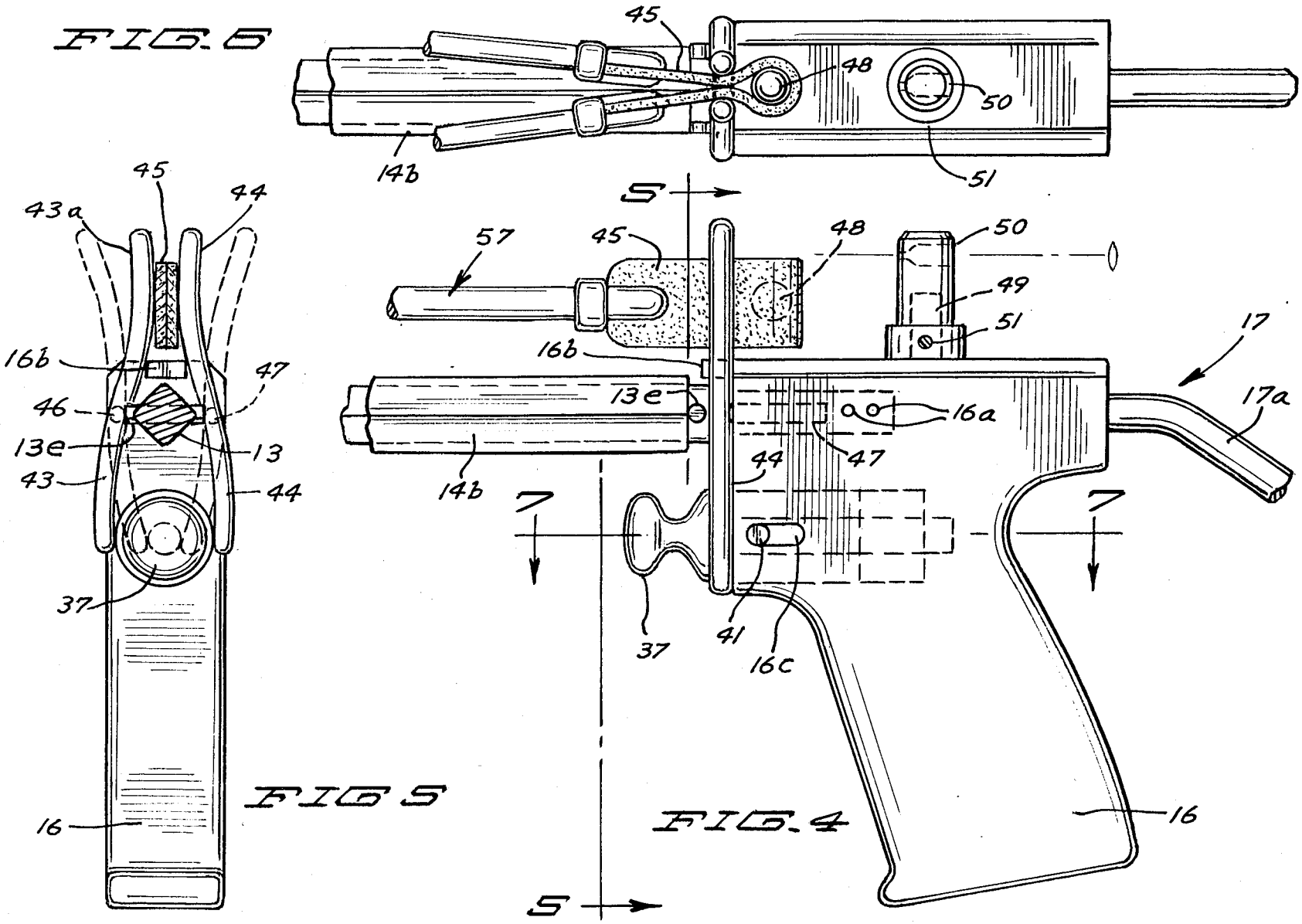
FIG. 4 is a broken view in side elevation on an enlarged scale showing details of structure.
FIG. 5 is a view in vertical section taken on line 5—5 of FIG. 4 as indicated.
FIG. 6 is a top plan view of the structure of FIG. 4.

Said pouch pins are respectively pivoted in position by pivot pins 46 and 47 (FIG. 5) embedded into said handle 16. The upper portions 43*a* and 44*a* of said pouch pins are curved somewhat toward each other and curved outwardly at their top portions for easy placement of the missile pouch therebetween as shown in FIGS. 4–6. A missile 48 is shown carried by said missile pouch in FIG. 6.

In molding the handle 16, a small post 49 is shown formed extending upwardly to provide a means for having placed thereon a rear sight 50 which is pressure fit thereon and a set screw 51 is tapped therethrough to secure its position. The sights are positioned so that a sighting can be taken on a line above the missile pouch 45.

A pin 13*e* disposed through the barrel 13 is a rear stop for the barrel 14 and a forward thrust bearing for the pouch pins 43 and 44.

OPERATION

The device described herein has proved to be an unusually accurate and effective weapon.

Preferably a steel ball such as the pellet 48 will be used for a missile. The pellet is placed in the pouch 45 and the band 57 is pulled back to place the pouch between the pins 43 and 44 with the pellet behind the pins. In this position the pouch pins are separated at their bottom portions by the full width of the plunger causing the upper portions 43*a* and 44*a* of the pins to be converged in close proximity to one another and bear against the projection 16*b*.

The grips or handles 16 and 18 are then taken in hand and the forward grip 18 is moved forwardly to extend the barrels 13 and 14 to the point that the plunger projects its upper end grooved portion through the opening 14c in the barrel 14. The pin 14a limits the extension of said barrel 14 and upon the plunger extending through said opening 14c, the forward end 13d of the barrel 13 under tension of the band 57 will engage the annular slot 19a. Thus the barrels are locked in extended position and the device is cocked ready for firing.

The safety bolt with the annular groove 41a therein being engaged by the ball 43 prevents the release of the missile by accident.

Figure 7:
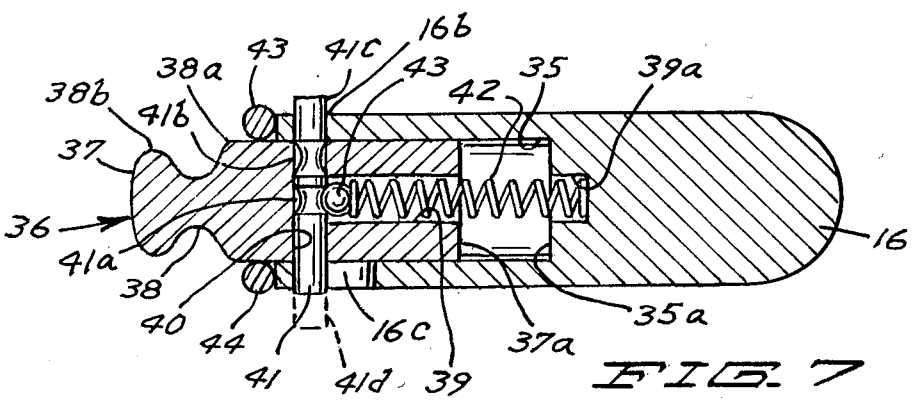
FIG. 7 is a view in horizontal section taken on line 7—7 of FIG. 4 as indicated.

To release the missile, the safety bolt 41 is moved to the operators left as viewed in FIG. 7, the device is sighted and the plunger 37 is pressed inwardly causing the lower portions of the pouch pins to become dislodged from the barrel portion of the plunger 36. The pressure of the missile pouch against upper portions of the pouch pins cause their instant separation as their lower portions retract into the groove 38. The forward wall 38a of said groove preferably is an an angle of 45° of permit a very sudden retraction of the lower portions of said pouch pins which results in a very quick and uniform release of the missile pouch to catapult the missile.

A conventional type of rear sight is used. Having spaced annular stripes on the front sight permits positioning the device for elevation in accordance with the distance of the target.

The device is readily cocked by the placement of the loaded missile pouch behind the pouch pins as illustrated and a separation of the handles 16 and 18.

To retract the extended barrels, the plunger 21 is depressed or pushed inwardly and its inner conical portion 21c bears against the inclined wall 19g causing the downward movement or retraction of the plunger 19 from its projection through the slot 14c. The barrels will telescope and the band 57 placed over the pouch pins will keep the device in retracted position.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A sling shot device, having in combination an extensible barrel, means releasably holding said barrel in extended position, a forward and rearward handle carried by said barrel, a pair of upstanding pins disposed at the face of said rearward handle extending above said handle, means pivotally securing said pins substantially centrally thereof to said handle, a plunger recessed into said rearward handle between the lower portions of said pins separating the same to cause the upper portions of said pins to converge, said plunger having a transversely narrowed portion outwardly of said pins, an elastic catapult member, means securing said catapult member at one end thereof to the forward end portion of said barrel, a missile pouch carried at the other end of said catapult member, a missile in said pouch, said pouch and said missile therein being disposed to be retained by said converged upper portions of said pins, said forward handle being moved forwardly of said rearward handle extending said barrel and placing said catapult member under tension, said plunger being movable inwardly of said handle permitting said lower portions of said pins to converge upon the narrowed portion of said plunger and thus causing the upper portions of said pins to spread apart and release said pouch and missile, means normally urging said plunger to extended position, means carried by said plunger releasably securing said plunger in extended position, a rearward portion of said barrel is slidable within the forward portion thereof, said rearward portion of said barrel carries said rearward handle and said forward portion of said barrel carries said forward handle, said rearward barrel portion has a longitudinal slot for the length of its movement within said forward barrel portion, said slot having a forward wall, said forward barrel portion having a transverse pin therein as a stop member upon engagement with said forward wall, an opening in the bottom wall of said forward barrel portion, a vertical bore through said forward handle, a plunger in said bore, a spring under compression in said bore urging said plunger upwardly, the upper end portion of said plunger having an annular groove and an upward portion of reduced transverse dimension movable through said opening, whereby said slot serves as a stop member for the adjacent end portion of said rearward barrel portion.

2. The structure of claim 1, including a bolt extending transversely through said plunger and through openings in said handle at each side of said plunger, one of said openings forming a slot for movement of said bolt rearwardly of said handle, means normally urging said plunger to extended position, whereby axial movement of said bolt through said plunger to extend through said slot permits said plunger to be moved inwardly of said handle in a triggering action.

3. The structure of claim 1, including a sight carried at the forward end of said forward barrel portion, comprising a vertical tube in said barrel, a cylindrical flexible sight member disposed through said tube, and said sight member being movable vertically of said tube.

4. The structure of claim 1, including a horizontal bore extending inwardly of said forward handle short of intersecting said vertical bore therein, a counter bore of reduced dimension extending from said horizontal bore to intersect said vertical bore, a plunger in said bore extending outwardly thereof, said plunger having a rearward extension thereof of reduced dimension extending through said counterbore, means urging said extended portion of said plunger to be in retracted positions, a groove in said first mentioned plunger having a bottom inclined wall, said extension of said last mentioned plunger having a conical terminal portion, whereby upon said second mentioned plunger being pressed inwardly of said horizontal slot, said extension thereof engages said inclined wall causing said plunger in said vertical bore to retract from said opening in said bottom wall and permits said barrel portions to telescope.

5. The structure of claim 4, including a slot in said forward handle communicating with said horizontal bore therein, and a pin extending through said slot and being secured to said plunger within said horizontal bore limiting the outward movement of said plunger.

* * * * *